United States Patent [19]

Spence

[11] 4,193,744

[45] Mar. 18, 1980

[54] COMPRESSOR VALVE

[75] Inventor: William M. Spence, Kerens, Tex.

[73] Assignee: Nipak, Inc., Dallas, Tex.

[21] Appl. No.: 890,243

[22] Filed: Mar. 27, 1978

[51] Int. Cl.[2] ..... F04B 39/10

[52] U.S. Cl. ..... 417/567; 417/512; 417/454

[58] Field of Search ..... 417/454, 564, 569, 557; 137/512, 516.15

[56] References Cited

U.S. PATENT DOCUMENTS

| | | | |
|---|---|---|---|
| 1,561,175 | 11/1925 | Labus | 417/564 |
| 2,828,696 | 4/1958 | Wright | 417/567 |
| 2,932,312 | 4/1960 | Roeder | 137/516.15 |
| 3,077,899 | 2/1963 | Waibel | 137/512 |
| 3,206,110 | 9/1965 | Waibel | 417/567 |
| 3,372,648 | 3/1968 | Hammelmann | 417/567 |
| 3,508,849 | 4/1970 | Weber | 417/454 |
| 3,526,246 | 9/1970 | Leitgeb | 137/516.15 |

FOREIGN PATENT DOCUMENTS

| | | | |
|---|---|---|---|
| 2711837 | 6/1978 | Fed. Rep. of Germany | 417/454 |

*Primary Examiner*—William L. Freeh

*Attorney, Agent, or Firm*—Gerald G. Crutsinger; John F. Booth; Harry C. Post, III

[57] ABSTRACT

A compressor valve for use in a piston type compressor having an annular tapered shaped valve element spring-urged into a valve seat formed between the intake suction side of the valve body and an annular passage formed behind the seat which communicates with a central outlet passage formed in the exhaust side of the valve body. The piston in a compressor adapted to force fluid back through a plurality of inlet passages communicating with an annular passage which communicates with outlets in the valve body, said plurality of inlet passages being sealed by a spring-urged annular valve element. The piston sucks air into the inlet urging the first annular valve element off its seat to allow flow of the gas in through the outlet passage into the piston chamber. The piston then forces the air through the plurality of inlet passages urging the second valve element off its seat such that the gas flows around both the inner and outer sides of the valve element to the outlet of the compressor.

8 Claims, 8 Drawing Figures

COMPRESSOR VALVE

BACKGROUND OF THE INVENTION

The compression of medium and high molecular weight gases within a small bore reciprocating compressor often presents some troublesome and unique problems. Since these gases require a larger flow area than lighter gases, a design which incorporates this perimeter often requires a larger more costly cylinder. In addition to providing a certain gas flow area into and out of the valve, it is also necessary to provide a valve which will withstand minor quantities of liquid on the valve seat. Minor amounts of liquid cause the valve disc or plate to impact into the stop for the valve on opening, and on closing, a single drop of liquid on the seat appears as a hard lump to the valve disc with subsequent bending of the disc. The ability of the valve to continuously seal while being subjected to the above action, should ensure a long useful service life.

Attempts heretofore to reduce the impact forces in opening and closing of the valve have been attempted through dampening of a valve plate or disc. This dampening is achieved by either trapping gas behind the valve disc or plate to provide a gas cushion for the plate to impact into or providing a second plate loaded with a spring force.

Heretofore, no valves have allowed passage of gas on both sides of an annular valve ring which has a short stroke to limit the problems which occur on impacting a droplet of moisture on the valve seat or behind the valve.

SUMMARY

I have devised a valve comprising a body divided into two sections: a suction side and an outlet side. The suction side has an annular chamber formed therein communicating with a plurality of inlet passages. A seat is formed between the annular chamber in the inlet passages to receive a tapered, annular ring-shaped valve element which is spring-urged to the closed position. The annular passage in the suction side communicates with an outlet which communicates with the cylindrical compression chamber of the reciprocating piston compressor. A plurality of inlets communicate with the compression chamber and communicate with an annular chamber formed in the outlet side of the valve body which communicates with the exhaust side of the compressor. An annular ring-shaped tapered valve element is spring-urged into a valve seat formed between the second annular chamber in the outlet and the inlet passages.

The annular passage is wide enough to allow movement of gases around the inside of the valve element and the outside of the valve element to increase the flow area of the valve.

The primary object of the invention is to provide a valve which significantly increases the gas flow area in a small reciprocating piston type compressor adapted for moving medium and high molecular weight gases.

A further object of the invention is to provide a valve element which increases the flow area and reduces the stroke of the valve element to reduce the impact forces from droplets which may be in the gas and reduce the bending forces which result from the droplets on the valve seat.

A further object of the invention is to provide a design which would significantly reduce disc breakage and increase the seat life of the valve and at the same time reduce the power needed to compress the gas.

Other and further objects of the invention will become apparent upon a detailed study of the hereinafter following specification and the drawings annexed hereto.

DESCRIPTION OF THE DRAWINGS

Drawings of a preferred embodiment of the invention are annexed hereto so that the invention may be better and more fully understood, in which.

Numeral references are used to designate like parts throughout the various figures of the drawing.

DESCRIPTION OF A PREFERRED EMBODIENT

Figure 1:
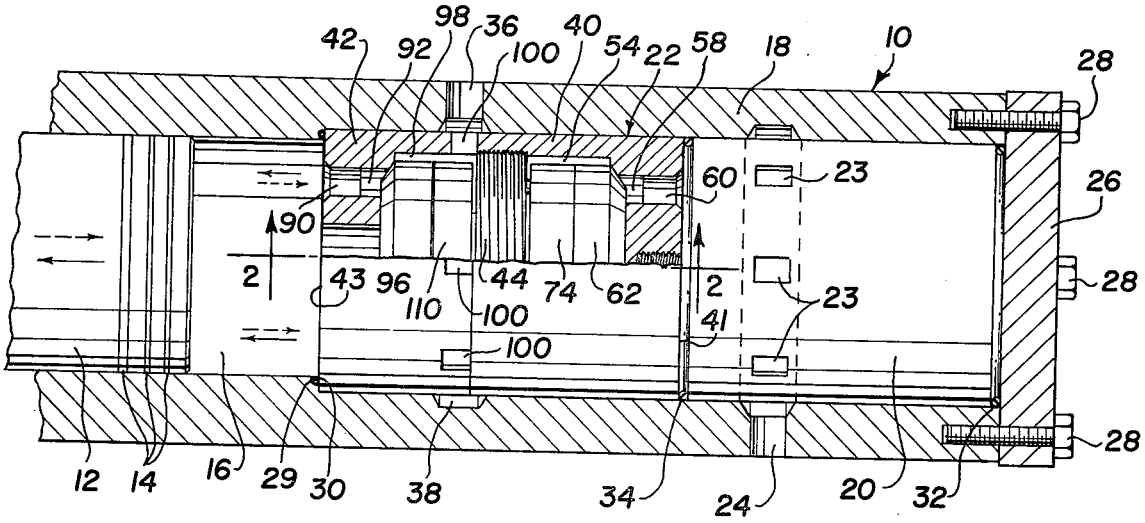
FIG. 1 is a partial sectional view of the valve in a reciprocating piston compression chamber with parts broken away to more clearly illustrate the details of construction.
Figure 2:
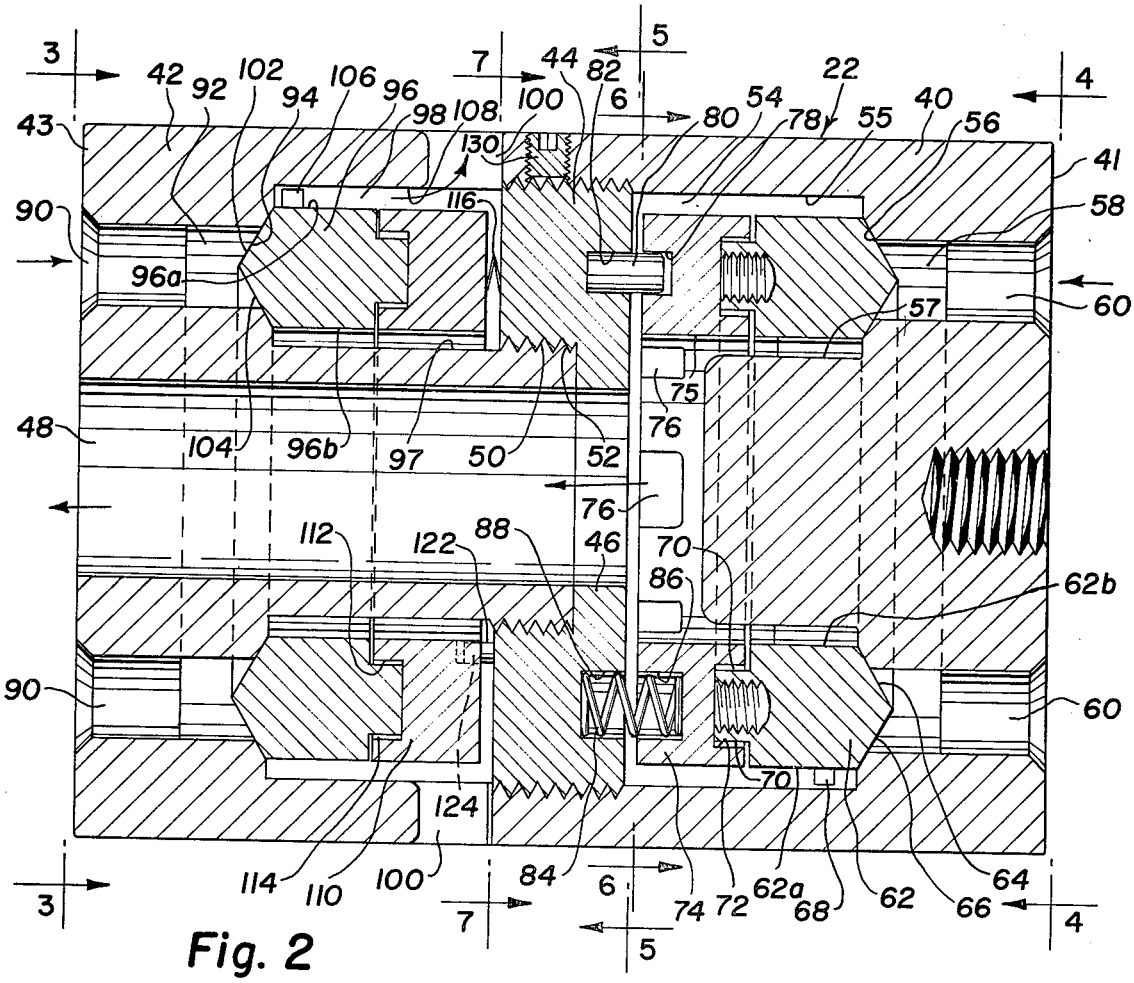
FIG. 2 is an enlarged cross-sectional view of the valve taken along line 2—2 of FIG. 1.
Figure 3:
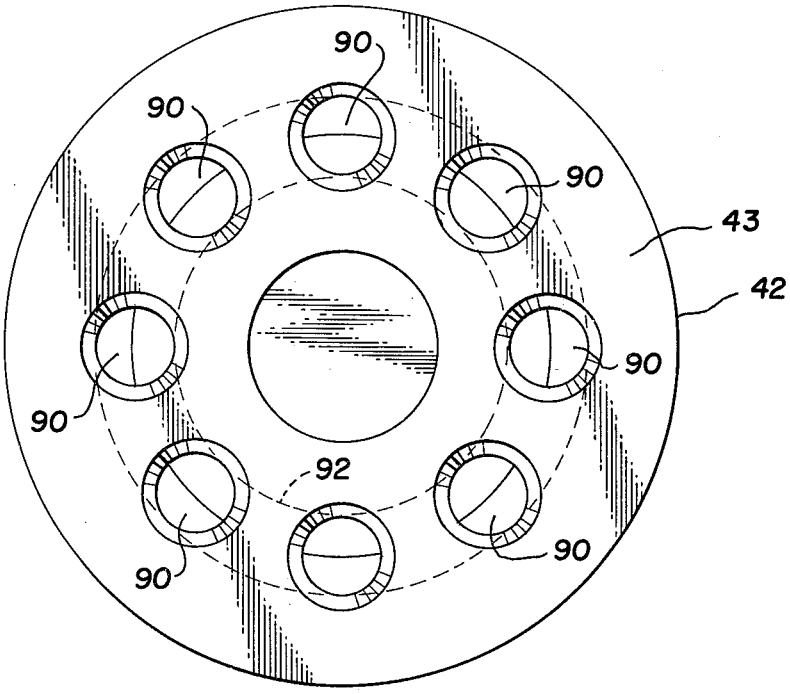
FIG. 3 is an end view taken along line 3—3 of FIG. 2.
Figure 4:
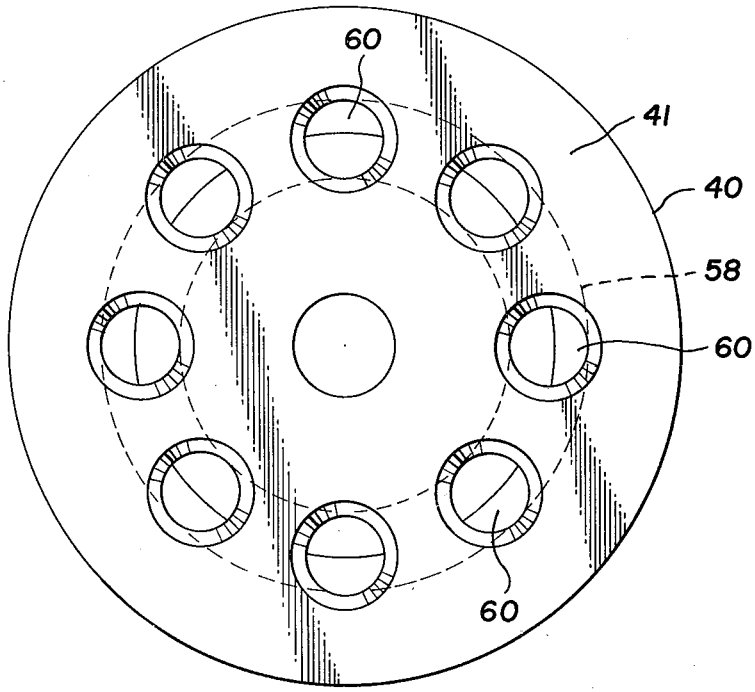
FIG. 4 is a right end view taken along line 4—4 of FIG. 2.
Figure 5:
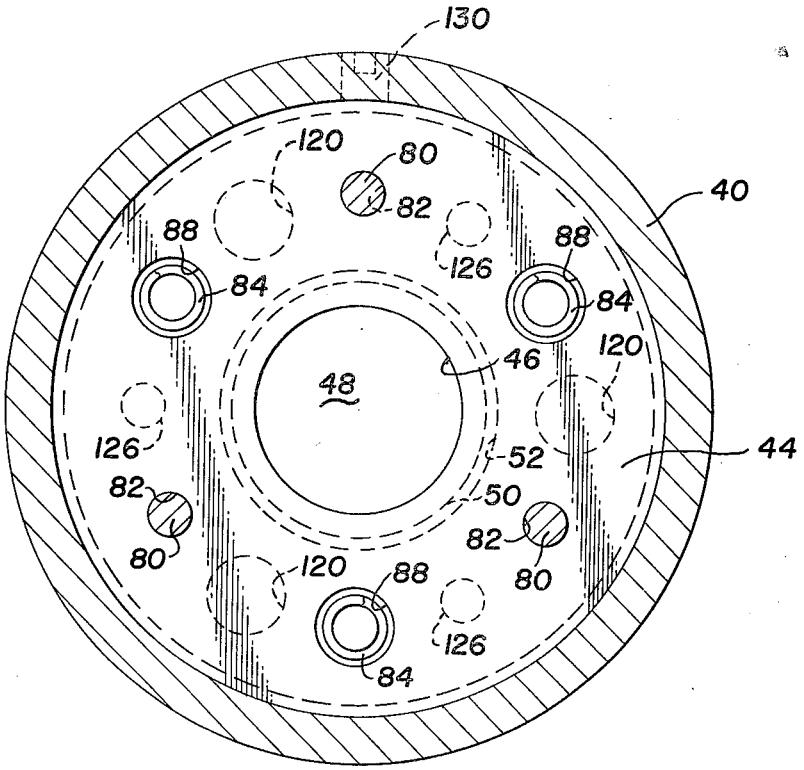
FIG. 5 is a cross-sectional view taken along line 5–5 of FIG. 2.
Figure 6:
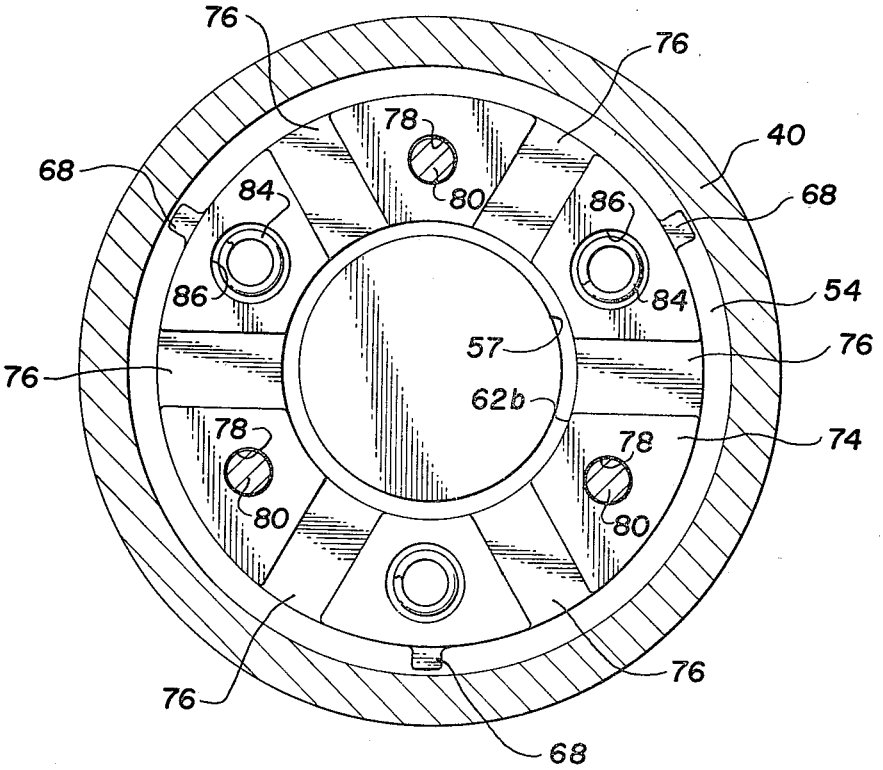
FIG. 6 is a cross-sectional view taken along line 6—6 of FIG. 2.
Figure 7:
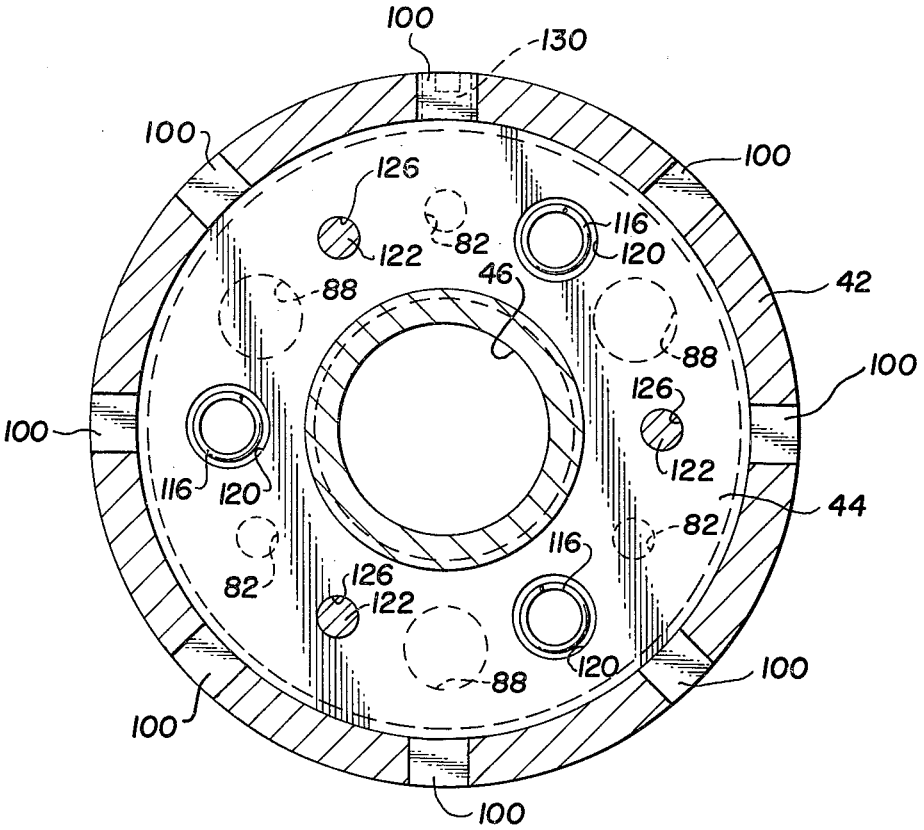
FIG. 7 is a cross-sectional view taken along line 7—7 of FIG. 2.
Figure 8:
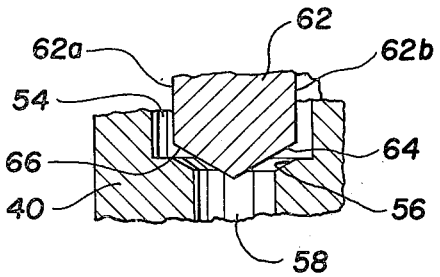
FIG. 8 is a partial sectional view showing the valve element open off of the valve seat on one side.

Referring to FIG. 1 of the drawings, the reciprocating piston type compressor is generally designated 10 and typically comprises a reciprocating piston 12 having a plurality of piston rings 14 which reciprocate in compression chamber 16 formed by cylinder wall 18 of compressor 10. A hollow cylinder 20 is formed on the other side of the valve 22 and has ports 23 which communicate with inlet 24. An end plate 26 seals off the end of cylinder 20 and is secured to the end of cylinder wall 18 by bolts 28.

The valve 22 is secured against an O-ring 29 and shoulder 30 formed in cylinder wall 18 on one end and is secured in position to limit longitudinal movement through the cylinder 18 by cylinder 20. O-rings 32 and 34 are positioned on opposite ends of cylinder 20. A discharge port 36 is formed in the cylinder wall 18 and communicates with an annular discharge passage 38 formed on the inside of wall 18.

Valve 22, as best illustrated in FIGS. 2 through 7, generally comprises a cylindrical shaped body divided into two sections having a suction end body 40 and a discharge end body 42. Th suction end body 40 is internally threaded and secured to externally threaded spacer plate 44 which is centrally located between the suction end body 40 and the discharge end body 42. Spacer plate 44 has a passage 46 formed centrally therethrough which communicates with suction end outlet passage 48 formed centrally through the discharge end body 42. The discharge end body 42 has threads 50 to engage an internally threaded counterbore 52 of spacer plate 44 to secure the suction end body 40 to discharge end body 42.

An annular passage 54 is formed in the interior of suction end body 40. A valve seat 56 is formed in the end of the annular passage 54 adjacent end 41 of the suction end body 40. An annular passage 58 is formed adjacent the valve seat 56 which communicates with a plurality of suction inlet passages 60.

Means to open and close the inlet passages 60 and annular passage 58 comprises an annular suction valve disc 62 having tapered valve surfaces 64 and 66 formed thereon. The suction valve disc 62 has three lugs 68 spaced equally about the peripheral edge 62*a* of valve disc 62 such that they maintain disc 62 centered from the inner wall 55 of passage 54. The inner wall 62*b* of suction valve disc 62 is spaced from the inner wall 57 of passage 54 to allow passage of gas between the seat 56 and surface 64 when the valve disc 62 is in the open position.

Suction valve disc 62 has shoulders 70 to engage a groove 72 formed in suction dampening plate 72 which comprises an annular ring having a passage 75 formed therein and notches 76 which communicate with the suction end outlet passage 48. The suction dampening plate 74 has counterbores 78 slideably disposed on alignment pins 80 which are pressed into holes 82 and spacer plate 44.

Means to urge the dampening plate 74 and suction valve disc 62 toward end 41 such that surfaces 64 and 66 seal with seat 56 comprise a plurality of springs 84 disposed in counterbores 86 and 88 formed in dampening plate 74 and spacer plate 44 respectively.

Suction from movement of piston 12 in the direction shown in solid line in FIG. 1 causes the suction valve disc 62 to be pulled off of the seat 56 opening passage 58 and inlet passages 60 to allow movement of gaseous fluid to pass the valve disc 62 into annular passage 54 and suction outlet passage 48 formed in discharge end body 42. A plurality of discharge end inlet passages 90 are formed in end 43 of discharge end body 42 and communicate with an annular discharge inlet passage 92. A discharge end valve seat 94 is formed adjacent annular discharge end inlet passage 92 to receive discharge valve disc 96. Annular discharge valve disc 96 is disposed in an annular discharge cavity 98 which communicates with a plurality of discharge passages 100 which communicate with an annular passage 38 and discharge port 36 in cylinder wall 18 of the compressor.

The annular discharge valve disc 96 is constructed similarly to suction valve disc 62, having surfaces 102 and 104 which engage the tapered valve seat 94. Inner wall 96*b* is spaced from the inner wall 97 of discharge cavity 98. Lugs 106 are spaced about the outer wall 96*a* of discharge valve disc 96 to space the valve disc 96 from the outer wall 108 of cavity 98. Discharge dampening plate 110 has a groove 112 which engages shoulder 114 on discharge valve disc 96. Discharge dampening plate 110 is spring-urged by springs 116 disposed in counterbores 118 and 120 in dampening plate 110 and spacer plate 44 respectively, to the closed position against valve seat 94. A dampening plate 110 is aligned on alignment pins 122 which is slideably disposed in counterbores 124 and pressed fitted into holes 126 and spacer plate 44. Alignment pins 122 and springs 116 are spaced approximately 30° from the spring 84 and pins 80 on the opposite side of plate 44.

Operation of the hereinbefore described device is as follows:

Movement of piston 12 in the direction of solid arrows shown in FIG. 1 forms a partial vacuum in the compression chamber 16 which is drawn through suction end outlet passage 48, passage 46 and passage 54, drawing the suction valve disc 62 off of seat 56 until counterbore 78 bottoms on alignment pins 80. Fluid is drawn through inlet 24, through cylinder 20 through suction inlet passages 60, annular passage 58, through annular passage 54 and suction end outlet passage 48. As the piston 12 stops to reverse movement, suction valve disc 62 is urged into the closed position by springs 84 such that surfaces 64 and 66 seal against seat 56. As piston 12 moves in a direction of dashed arrows shown in FIG. 1, the fluid is urged into inlet passages 90, through annular discharge passage 92 urging discharge valve disc 96 off of seat 94. The fluid is urged about both sides of discharge valve disc 96 into the annular passage 98 and out spaced discharge passages 100 and into the annular passage 98 and out discharge port 36. Springs 118 urge dampening plate 110 and discharge valve disc 96 back against the port 94 as movement of the piston 12 stops to reverse to begin the suction cycle.

Fluid moves about both sides thereby limiting the distance that the suction valve disc 62 and discharge valve 96 must be opened and reducing damage caused by impacting fluid particles against surfaces 64 and 66 of suction valve disc 62 and surfaces 102 and 104 on discharge valve disc 96.

All materials of the valve body spacer and dampening plate and valve discs are preferably constructed of stainless steel and heat treated to provide a minimum yield strength of 100,000 psi in an IZOD impact test of 50 ft. pounds minimum. This may be achieved by heat treating No. 431 stainless steel for 30 minutes at 1900° F. and oil quenching to 150° to 200° F., reheating to 300° F. for 15 minutes and water quenching. The steel may be tempered by heating for two hours at 875° F. The springs are preferably constructed of stainless steel to maintain their rigidity and integrity within the valve 22.

A set screw 130 is threadedly secured into the side of suction end body 40 to engage the threads on spacer plate 40 to prevent rotation relative thereto.

Seats 56 and 94 are preferrably lapped to provide a smooth sealing surface.

Having described my invention, I claim:

1. In a compressor having a reciprocating piston slideably disposed in a compression chamber formed by a cylinder, said compression chamber having an inlet passage and an outlet passage, a valve disposed between said inlet and outlet passages comprising: a suction end body having an inlet communicating with the inlet in said compression chamber, said inlet communicating with an annular passage formed in said body which communicates with the compression chamber; a suction valve seat formed in said body formed between the inlet passage and annular passage; an annular suction valve disc disposed in said annular passage having an outer side spaced from the outer wall of said annular passage and an inner wall of said valve disc being spaced from the inner wall of said annular passage; means to urge said sucton valve disc into sealing relation with said suction valve seat; a suction dampening plate secured between said means to urge said suction valve disc in sealing relationship with said suction valve seat and said suction valve disc; a discharge valve body having an inlet communicating with said compression chamber said inlet communicating with an annular discharge passage formed in said discharge end body, said annular discharge passage communicating with the outlet of said compression chamber; a discharge valve seat formed between said inlet and annular passage in said discharge end body; a discharge valve disc having an outer side spaced from the outer wall of said annular discharge passage and an inner side spaced from the inner wall of said annular discharge passage; means to urge said discharge valve disc into sealing relation with said discharge valve seat, said discharge valve disc being adapted to move off of said discharge valve seat when gases are being compressed through said inlet in said discharge end body and said suction valve disc being adapted to be urged off of said suction valve seat when gases are being pulled through said compression chamber inlet to said compression chamber; and a discharge dampening plate secured between said discharge valve disc and said means to urge said discharge valve disc into sealing relationship with said discharge valve seat.

2. The combination called for in claim 1 wherein the means to urge said suction valve disc into sealing relation with said suction valve seat and a means to urge said discharge valve disc into sealing relation with discharge valve seat comprises: a plurality of resilient springs disposed in spaced relationship between the body and the respective dampening plates.

3. The combination called for in claim 1 wherein said suction valve disc comprises: a ring-shaped element having a tapered sealing surface adapted to engage the suction valve seat.

4. The combination called for in claim 1 with the addition of: spacer means formed on the side of said suction valve disc to position said suction valve disc in said annular passage.

5. The combination called for in claim 1 wherein said discharge valve disc comprises: a ring-shaped element having a tapered sealing surface adapted to engage the discharge valve seat.

6. The combination called for in claim 1 with the addition of: spacer means formed on the side of said discharge valve disc adapted to position said discharge valve disc in said annular discharge passage.

7. The combination called for in claim 1 with the addition of: alignment means adapted to maintain alignment of said suction valve disc and said discharge valve disc in relationship to said suction valve seat and discharge valve seat respectively.

8. The combination called for in claim 1 wherein said suction and discharge dampener plates comprise: annular rings having first and second surfaces, said rings having an annular groove formed in the first surface adjacent said respective suction and discharge valve discs to receive said valve disc, and said rings further having a plurality of spaced counterbores formed in the second surface to receive said means to urge said suction and discharge valve discs.

* * * * *